United States Patent [19]

Krings

[11] Patent Number: 4,657,442

[45] Date of Patent: Apr. 14, 1987

[54] CRIBBING DEVICE FOR TRENCHES

[75] Inventor: Josef Krings, Heinsberg, Fed. Rep. of Germany

[73] Assignee: Krings International GmbH & Co. KG, Heinsberg, Fed. Rep. of Germany

[21] Appl. No.: 749,572

[22] Filed: Jun. 27, 1985

[30] Foreign Application Priority Data

Jun. 28, 1984 [DE] Fed. Rep. of Germany ..... 3423853

[51] Int. Cl.[4] ..... E21D 5/12

[52] U.S. Cl. ..... 405/282; 248/558; 211/182; 405/272

[58] Field of Search ..... 405/272, 278, 281, 282, 405/283; 248/228, 558; 211/182

[56] References Cited

U.S. PATENT DOCUMENTS

| | | | |
|---|---|---|---|
| 3,335,573 | 8/1967 | Ward | 405/282 |
| 3,910,053 | 10/1975 | Krings | 405/282 |
| 3,950,952 | 5/1976 | Krings | 405/282 |
| 4,274,763 | 6/1981 | Krings | 405/272 |
| 4,376,599 | 3/1983 | Krings | 405/282 |

FOREIGN PATENT DOCUMENTS

| | | | |
|---|---|---|---|
| 2323321 | 5/1973 | Fed. Rep. of Germany | 405/282 |
| 2949312 | 6/1981 | Fed. Rep. of Germany | 405/282 |
| 0036221 | 2/1982 | Japan | 405/282 |
| 2053314 | 2/1981 | United Kingdom | 405/282 |

*Primary Examiner*—Cornelius Husar
*Assistant Examiner*—Kristina I. Hall
*Attorney, Agent, or Firm*—Collard, Roe & Galgano

[57] ABSTRACT

A cribbing device for trenches which includes a pair of opposing supports spaced apart by a spreader, each support having a plurality of guide profiles and a crosspiece. The crosspiece is disposed transversely to the longitudinal axis of the trench, and the guide profiles are arranged adjacent each other on said crosspiece. The guide profiles include a plurality of legs disposed vertically and extending outward from the crosspiece, and a plurality of flanges disposed vertically and secured to the legs at the ends of the legs opposite the crosspiece. The flanges project beyond both sides of the legs. A plurality of cribbing boards each having a guide bar which supports a guide head is provided. The guide head is in the form of a slotted hollow box section and extends vertically beyond the board at its vertical face side. The width of each guide profile flange is slightly smaller than the inside width of the guide heads. The slot of the guide heads corresponds to the legs of the guide profiles, and the inside spacings between the legs of the adjacent guide profiles is slightly larger than the total width of the guide heads. The boards may, therefore, be guided and supported by the supports by engaging the guide heads of the boards with the guide profiles of the supports thereby permitting the boards to be passed by each other on parallel planes and to be supported by the supports in a form-locked manner.

5 Claims, 5 Drawing Figures

CRIBBING DEVICE FOR TRENCHES

BACKGROUND OF THE INVENTION

The present invention relates to a cribbing device for trenches consisting of supports which oppose each other in pairs and which are kept spaced apart by spreaders, and cribbing plates guided and supported in the supports in a form-locked manner. The supports have guiding profiles arranged next to each other vertically on crosspieces disposed transversely to the longitudinal axis of the trench. The guiding profiles engage the cribbing plates which are capable of being guided past each other on parallel planes. Furthermore, the guiding profiles arranged on each crosspiece of a support consist of equal legs standing vertically on the crosspiece of the support. Flange parts are vertically arranged with respect to the legs and are secured on the free ends of the legs. The width of the flange parts is slightly smaller than the inside width of the guide heads of the cribbing plates. The inside spacings between two adjacent crosspiece parts are slightly larger than the total width of the guide heads of the cribbing plates. The guide heads extend at the vertical face sides wholly or partially beyond the height of the cribbing plates and are designed in the form of sectionally outwardly open, slotted hollow box profiles (C-profiles). The position of the slot in the guide head conforms to the position of the crosspeice part of each guiding profile.

A cribbing device of this type is disclosed in German published patent disclosure DE-OS No. 29 49 312. With this device, it is possible to connect consecutively arranged cribbing plates of the above-specified type with a support in a form-locked way and to install such cribbing plates in the trench with stepwise displacement. With this known cribbing device, the spacing of the support is substantially preset and determined, or fixed.

In trench cribbing operations with cribbing plates of a large size, the situation may be such that the supports to be placed collide with transverse conduits such as, for example, building service lines, so that the cribbing series with large-sized plates is interrupted and small materials such as, for example, pile boardings or the like must be installed. Thus, it would be desirable to have available a simple means by which the cribbing length can be changed to accommodate such interferences.

This is all the more important with multistage cribbing operations. Furthermore, a cribbing may have to be constructed in places where phenomena of flow appear beneath the bottom stage, for example, in a two-stage cribbing, and where such phenomena require an additional cribbing stage possibly only over a short distance of the trench. As a rule, however, this cannot be achieved without the use of additional special cribbing materials.

Accordingly, it is an object of the present invention to provide a cribbing device which is adapted to provide a variable cribbing length and also an additional cribbing stage when required with a simple embodiment without the need to provide cribbing materials of varying lengths or types.

It is also an object of the present invention to provide such a cribbing device which can be used both for normal cribbing and which can also be used to provide for changes in the length of the spacing between two supports and/or changes in the cribbing depth.

SUMMARY OF THE INVENTION

The above objects, as well as others which will hereinafter become apparent, are accomplished in accordance with the present invention by providing a cribbing device which includes a pair of opposing supports spaced apart by a spreader, each support having a plurality of guide profiles and a crosspiece, the crosspiece being disposed transversely to the longitudinal axis of the trench. The guide profiles are arranged adjacent to each other on the crosspiece, and include a plurality of legs disposed vertically and extending outward from the crosspiece, and a plurality of flanges disposed vertically and secured to the legs at the ends of the legs opposite the crosspiece. The flanges project on both sides beyond the legs.

A plurality of cribbing boards each having a guide bar which supports a guide head are included. The guide head is in the form of a slotted hollow box section and extends vertically beyond the board at its vertical face side.

The width of each guide profile flange is slightly smaller than the inside width of the guide heads with the slot of the guide heads corresponding to the legs of the guide profiles. The inside spacing between the legs of the adjacent guide profiles is slightly larger than the total width of the guide heads.

The boards, therefore, may be guided and supported by the supports by engaging the guide heads of the boards with the guide profiles of the supports, thereby permitting the boards to be passed by each other on parallel planes and to be supported by the supports in a form-locked manner.

It is possible to guide and support the guide bars of the cribbing boards or plates either between two crosspiece parts of the guiding profiles of a support or on the flange parts of the support. The last-mentioned measure results in a larger support spacing while maintaining a form-locked connection between the support and the cribbing plate.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE DRAWINGS

Figure 1:
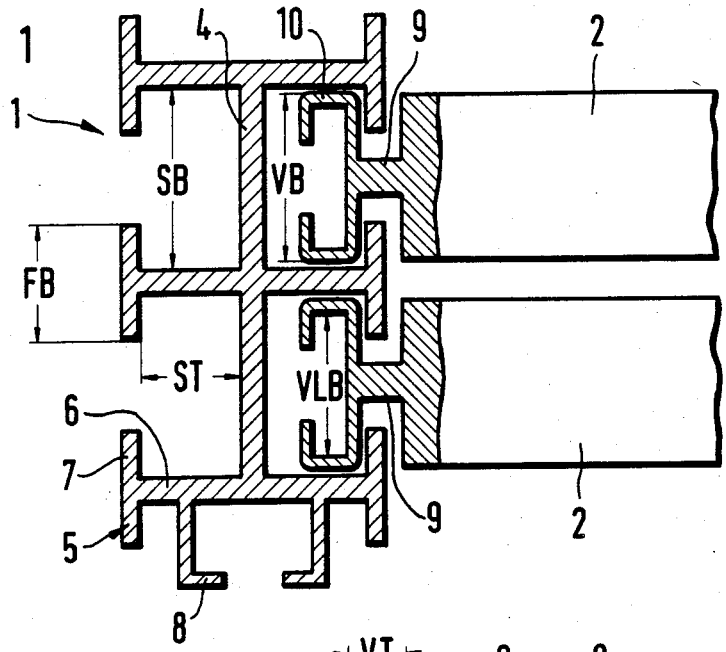
FIG. 1 is a schematic top fragmentary sectional view of a cribbing support according to the invention with installed, cribbing boards for two cribbing stages.

Turning now to the drawings, FIG. 1 shows a support 1 for a multistage cribbing device. Such a cribbing device consists of supports, cribbing boards 2 guided and supported on their face sides in or on said supports, and spreaders 3 (see FIG. 3), which are mounted or guided on the oppositely disposed supports 1 and thus between said supports, maintaining said supports spaced apart across the width of a trench. With multistage cribbing devices, the cribbing plates or boards are supported on different planes, so that the boards can be guided past each other. In this case, the cross section of the trench is necessarily stepped. A trench cribbing device of said type is known from German Patent DE-PS No. 23 02 053.

Support 1 is comprised of a crosspiece 4 extending in the installed condition transversely to the longitudinal axis of the trench. The guide profiles 5 for cribbing board 2 are disposed on each crosspiece 4 perpendicularly thereto, i.e., aligned in the longitudinal direction of the trench. Guide profiles 5 have T-shaped profiles having a leg 6 disposed vertically and at right angles to the crosspiece 4 of support 1. The free end of leg 6 supports a flange 7 which also extends vertically.

Two adjacent guide profiles 5 form a slotted hollow box profile having, as shown in FIGS. 1–5, a symmetrical C-shaped section. However, flanges 7 may also be arranged on legs 6 with an unsymmetrical displacement.

A slotted hollow box profile 8 is arranged on the end of support 1 facing the interior of the trench. Profile 8 serves to receive the head 17 of spreader 3 (see FIGS. 3–5). Hollow box profile 8 may alternatively be U-shaped.

On their vertical face sides, cribbing boards 2 are provided with guide bars 9 having a substantially T-shaped profile. Guide bars 9 cooperate with guide profiles 5 of support 1 and extend wholly or partially beyond the height of the face sides of cribbing board 2. Each flange part of a guide bar 9 forms a guide head 10 and is provided in the form of a sectionally outwardly open, slotted hollow box profile (C-profile), which does not necessarily have to be symmetrical within itself and with respect to cribbing board 2.

The inside spacings SB of two adjacent crosspieces 6 of guide profiles 5 are slightly larger than the total width VB of each guide head 10 of cribbing board 2 (see FIG. 1). Furthermore, the inside spacing ST between crosspiece 4 of support 1 and flanges 7 of guide profiles 5 is larger than the total depth VT (see FIG. 2) of each guide head 10. Moreover, the width FB (see FIG. 1) of flange parts 7 of guide profiles 5 is slightly smaller than the inside width VLB of each guide head 10. Legs 6 are arranged in such a way that the arrangement conforms to the position of the slot 11 of the associated guide head 10.

Under these conditions, the guide head 10 may be inserted in the slotted hollow box profiles formed by the guide profiles (as is the case with the state of the art) and supported therein in a known form-locked manner, i.e., firmly fixed under push-and-pull conditions.

Figure 2:
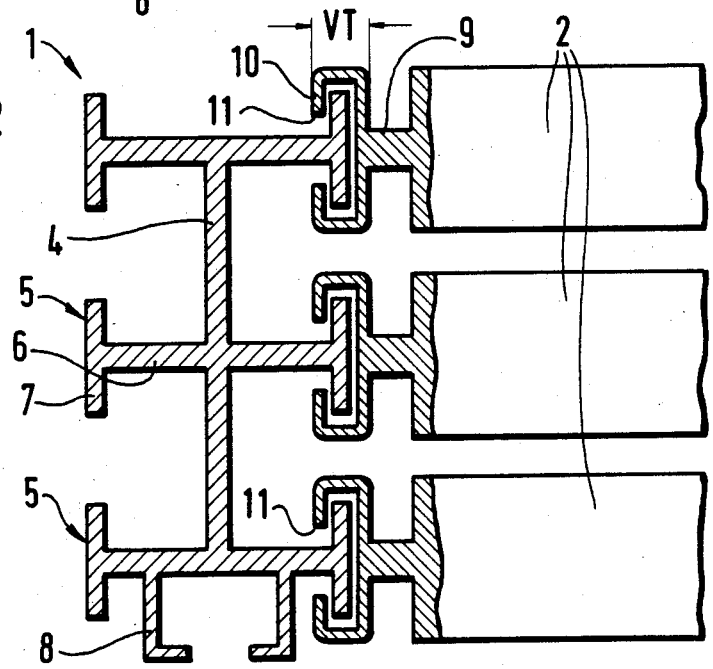
FIG. 2 is a schematic top fragmentary sectional view of a support according to the invention in FIG. 1, but with cribbing boards for three cribbing stages.

As can be seen in FIG. 2, three-stage cribbing is possible with the use of the same support 1 and the same cribbing boards 2. In this case, guide heads 10, designed in the form of slotted hollow box profiles, are pushed over the T-shaped section guide profiles 5 and are supported thereon in a form-closed manner fixed under push-and-pull conditions. This technique is also known per se. At the same time, however, the support spacing is enlarged in the longitudinal direction of the trench by about two times the depth of a guide head 10. While this change in support spacing is relatively small, it does provide some flexibility as to where the supports can be located. Of course, this spacing variation is available between each consecutive support, or in each link section of the cribbing or wall. Therefore, a large amount of flexibility as to the position of any one support can be obtained by appropriately selecting the larger or smaller support spacings of adjacent supports.

The three-stage cribbing so formed requires hardly any additional vertical space with respect to the axis of the trench than does the two-stage cribbing, and no design changes are required with respect to the cribbing elements.

Figure 3:
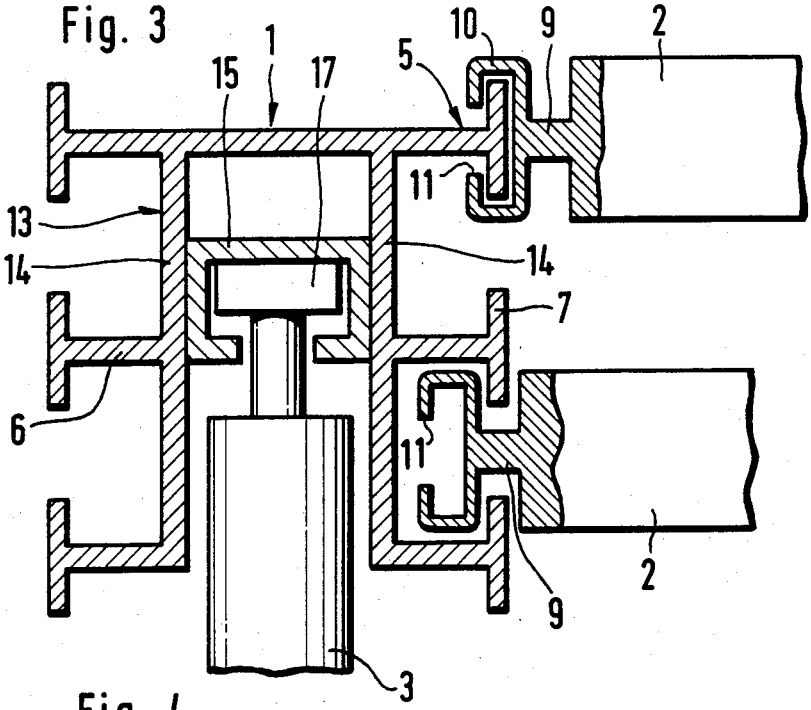
FIG. 3 is a schematic top fragmentary sectional view of a modified support design depicting two variations for connecting the support with a cribbing board or plate.
Figure 4:
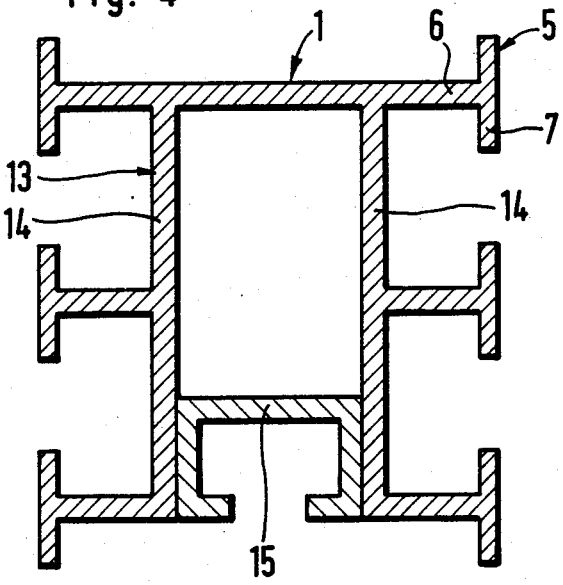
FIG. 4 is a schematic top sectional view of another type of support design.

FIGS. 3 and 4 show a support arrangement similar to the one shown in FIGS. 1 and 2. In particular, FIG. 3 shows the alternative possibilities for the form-locked connection between a cribbing board 2 and support 1. Instead of using the simple crosspiece 4, the embodiments shown in FIGS. 3 and 4 show a crosspiece designed as a U-profile 13 whose two legs 1 support guide profiles 5 on their outer sides.

Between the legs 14 of U-profile 13, a guide profile 15 is provided for head 17 of spreader 3. Guide profile 15 may be disposed at any desired depth, between legs 14.

Figure 5:
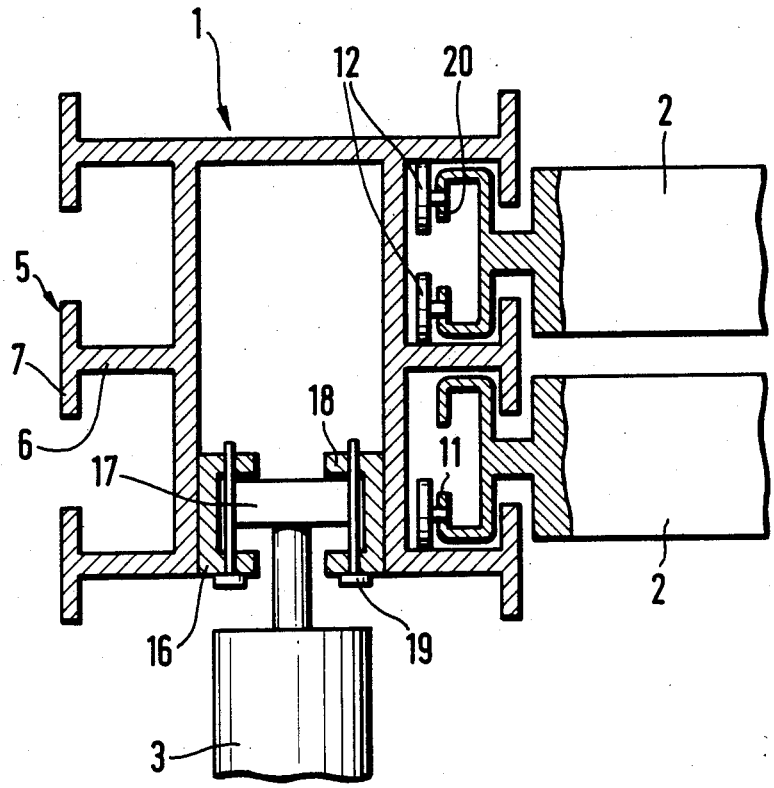
FIG. 5 is a schematic top fragmentary sectional view similar to FIG. 4 with cribbing boards or plates guided by means of rollers.

In FIG. 5, it is clearly shown that rollers 12 may be arranged at least on flange 20 of each guide head 10 directed towards the interior of the trench. Rollers 12 extend beyond the profile of guide head 10 and are supported on legs 6 of the associated guide profile 5. In this manner, the frictional forces acting on the cribbing elements may be reduced in a manner known per se.

Furthermore, FIG. 5 shows a modified guide profile 16 for head 17 of spreader 3. Guide profile 16 is composed of U-shaped members facing each other across a space, with spreader 3 being supported on the inside flange 18 of these members.

In order to support spreader 3 on a defined level, retaining bolts 19 are provided parallel to spreader 3. Bolts 19 can be inserted in profile 16 through suitable holes, and may be provided in the same way with the slotted hollow box profile 15 shown in FIG. 3.

While several embodiments of the present invention have been shown and described, it is obvious that many changes and modifications may be made thereunto, without departing from the spirit and scope of the invention.

What is claimed is:

1. A cribbing device for trenches which comprises:

a pair of opposing supports spaced apart by a spreader, each support having a plurality of guide profiles and a crosspiece, said crosspiece being disposed transversely to the longitudinal axis of the trench, said guide profiles being arranged adjacent each other on said crosspiece, and comprising a plurality of legs disposed vertically and extending outward from said crosspiece, and a plurality of flanges disposed vertically and secured to said legs at the ends of said legs opposite said crosspiece and projecting on both sides beyond said legs;

a plurality of cribbing boards each having a guide bar which supports a guide head, said guide head being in the form of a slotted hollow box section and extending vertically beyond said board at its vertical face side;

the width of each of said guide profile flanges being slightly smaller than the inside width of said guide heads with the slot of said guide heads corresponding to the legs of said guide profiles, and the inside spacings between the legs of the adjacent guide profiles and between the crosspiece and the flange of each guide profile being slightly larger than the corresponding dimensions of said guide heads, and the guide bar of said cribbing boards corresponding to the spacings between the flanges of adjacent guide profiles;

so that said boards may be guided and supported by said supports by engaging said guide heads of said boards with the flanges of said guide profiles or within the spacings between adjacent guide profiles;

thereby permitting said boards to be passed by each other on parallel planes and to be supported by said supports in a form-locked manner with the distance between adjacent supports being adjustable depending upon the engagement of the guide heads of said boards with the guide profiles of the supports.

2. The cribbing device as defined in claim 1, additionally comprising two or more rotatable rollers arranged on the outer side of the guide head disposed closer to the center of the trench, said rollers projecting slightly beyond the side of the guide head.

3. The cribbing device as defined in claim 1, wherein said crosspiece of each of said supports is U-shaped with the opening of the U facing the interior of the trench and having said guiding profiles arranged on its legs.

4. The cribbing device as defined in claim 3, wherein said spreader includes guiding heads at its ends and a guide profile is disposed between the legs of the U-shaped crosspiece for use as a guiding means for said heads of said spreader.

5. The cribbing device as defined in claim 4, additionally comprising holes for retaining bolts aligned transversely to the longitudinal direction of the trench and arranged in said guiding profile.

* * * * *